US005772310A

United States Patent [19]

Cserteg et al.

[11] Patent Number: 5,772,310

[45] Date of Patent: Jun. 30, 1998

[54] DISCHARGE LAMP CAP AND METHOD FOR FIXING THE DISCHARGE TUBE

[75] Inventors: Erzsebet Cserteg; Jozsef Fulop; Jozsef Tokes; Istvan Wursching, all of Budapest, Hungary

[73] Assignee: General Electric Company, Schenectady, N.Y.

[21] Appl. No.: 672,792

[22] Filed: Jun. 28, 1996

[30] Foreign Application Priority Data

Jul. 5, 1995 [HU] Hungary ..... 19635/95

[51] Int. Cl.[6] ..... F21S 3/00; F21K 27/00; H01J 5/48

[52] U.S. Cl. ..... 362/225; 362/217; 362/260; 313/318.01; 313/318.08

[58] Field of Search ..... 362/216, 217, 362/221, 222, 223, 224, 225, 260; 313/318.08, 318.01, 130; 439/226, 228, 229, 235, 236, 611

[56] References Cited

U.S. PATENT DOCUMENTS

| | | | |
|---|---|---|---|
| 503,108 | 8/1893 | Bates . | |
| 2,074,154 | 3/1937 | Stechbart . | |
| 3,706,902 | 12/1972 | Cookson | 313/318 |
| 3,808,495 | 4/1974 | Win | 362/223 |
| 4,661,890 | 4/1987 | Watanabe et al. | 362/217 |
| 4,695,767 | 9/1987 | Wittmann | 312/226 |
| 4,703,227 | 10/1987 | Takeda et al. | 313/634 |
| 4,924,368 | 5/1990 | Northup et al. | 362/260 |
| 4,963,785 | 10/1990 | Takagi et al. | 313/318 |
| 4,990,821 | 2/1991 | Blaisdell et al. | 313/318.08 |
| 5,001,387 | 3/1991 | Van Der Heijden | 313/318.08 |
| 5,086,249 | 2/1992 | Blaisdell et al. | 439/611 |
| 5,128,590 | 7/1992 | Holzer | 362/260 |
| 5,285,361 | 2/1994 | McKillip | 362/216 |
| 5,289,079 | 2/1994 | Wittmann | 362/221 |
| 5,463,270 | 10/1995 | Wakimizu et al. | 313/318.08 |
| 5,506,474 | 4/1996 | Hammer et al. | 313/130 |
| 5,541,477 | 7/1996 | Maya et al. | 362/216 |

*Primary Examiner*—Ira S. Lazarus
*Assistant Examiner*—Matthew J. Spark
*Attorney, Agent, or Firm*—George E. Hawranko

[57] ABSTRACT

A cap for securing a plurality of discharge tubes to a discharge lamp assembly includes a pair of ribs formed on a base plate of the cap. The ribs guide adhesive towards openings in the base plate through which the tubes extend. Adhesive is kept away from the base plate perimeter, which may include a rim, such that assembly of the cap with a housing does not upset the adhesive bond securing the discharge tubes to the cap. Similarly, an assembly method for the cap involves the step of forming a pair of ribs on the base plate of the cap.

15 Claims, 1 Drawing Sheet

DISCHARGE LAMP CAP AND METHOD FOR FIXING THE DISCHARGE TUBE

FIELD OF THE INVENTION

This invention relates to a cap for discharge lamps for orienting and fixing the discharge tube of the discharge lamp. This invention also relates to a method for fixing the discharge tube of a discharge lamp, e.g., of a compact fluorescent lamp in the cap of the discharge lamp.

BACKGROUND OF THE INVENTION

The cap is the part of the base part of the discharge lamp which incorporates the discharge tube. The base part also includes a housing provided with the contacts necessary for connection to the supply voltage, and, if needed, also incorporates circuitry for operating the discharge lamp. In the completed discharge lamp, the cap and housing are integrated.

Discharge lamps, primarily including compact fluorescent lamps, are commercially available with a so-called cap that serves to orient and fix the discharge tube of the discharge lamp. The cap is provided with openings for accepting the tube legs of the discharge tube, and the tube legs are fixed in the cap by means of an adhesive. Pairs of ribs parallel to each other serve for guiding the adhesive. Each of these belongs to one tube leg. Each of these pairs of ribs guides the adhesive from the rim of the cap to the adjacent tube leg.

The disadvantage of this solution is that the adhesive set produces a rigid joint both with the tube legs and the rim of the cap. When assembling the discharge lamp, i.e. during integrating the cap and the housing of the base part by snapping them together, the adhesive joint may get damaged, and the adhesive may leave the cap. Lamps having this fault will be rejected.

SUMMARY OF THE INVENTION

The objective of the invention is to provide a solution that eliminates the faulty product mentioned above.

It has been recognized that the objective of the invention can be achieved by putting the adhesive joint between the cap and the tube legs more distant from the rim of the cap so that the adhesive sets inside of the rim and does not come into contact therewith.

In accordance with the above, our invention is a cap of a discharge lamp for orienting and fixing the discharge tube of the discharge lamp. The said cap comprises a base plate provided with openings for accepting the tube legs of the discharge tube and a rim surrounding the base plate. The tube legs are fixed on the base plate of the cap by means of an adhesive, and ribs are formed in the cap for guiding the adhesive. The ribs are situated in pairs projecting from the plane of the base plate in the inner space of the cap and are formed in the space portions bordered by the rim of the cap and the arcs of two openings. Between the rib pairs, a slot is formed for guiding the adhesive towards the two adjacent tube legs. We note that the solution according to which the rib pairs meet, e.g., at a place more distant from the tube legs is also considered as a solution according to the invention.

It is advantageous if the pairs of ribs are convergent towards the tube legs. In this way, a narrowing slot formed between the ribs will guide the adhesive towards the tube legs if the adhesive is pressed in front of the ribs.

In another preferred embodiment, the slot broadens between the ends of the rib pairs close to the tube legs. This solution provides that the adhesive spreads as it approaches the tube legs.

It is also advantageous if the narrowest width of the slot is at least 1 mm so that the adhesive flows adequately between the ribs.

In addition, our invention is a method for fixing the discharge tube of a discharge lamp, e.g., of a compact fluorescent lamp in the cap of the discharge lamp, according to which method the glass tube legs of the discharge tube are placed into openings formed in the cap and the tube legs are fixed to the cap by means of an adhesive. The adhesive is held and guided by ribs formed in the vicinity of two adjacent openings in the cap prior to assembling. During assembling, the adhesive is pressed to the ribs in a quantity and directed in a way that it, guided by the ribs, extends to the tube legs placed in two closest neighboring openings. The cap and the ribs formed in the cap are advantageously made of a plastic material using injection molding.

In order to provide a safe joint, it is advantageous if each tube leg is fixed with the adhesive. It is also advantageous if the adhesive used has thixotropic (i.e. it liquefies under the effect of pressure) or thermoplastic properties. When a thermoplastic adhesive is used, it is pushed to the ribs after having been heated.

The advantage of the solution according to the invention is that it produces a safe joint between the tube legs and the cap without potential for damaging the cap or joint during assembling. It is a further advantage that by forming the ribs suitably, two tube legs can be fixed at the same time with one single dose of adhesive. By forming the pairs of ribs to make an angle with each other (i.e. to be convergent or divergent), the mechanical joint of the adhesive will also be provided for, which further increases the bond strength.

BRIEF DESCRIPTION OF THE DRAWINGS

The invention will be described in detail with reference to an embodiment illustrated by the FIGURE, which is an embodiment of the discharge lamp cap according to the invention.

DETAILED DESCRIPTION OF THE PREFERRED EMBODIMENTS

Figure 1:
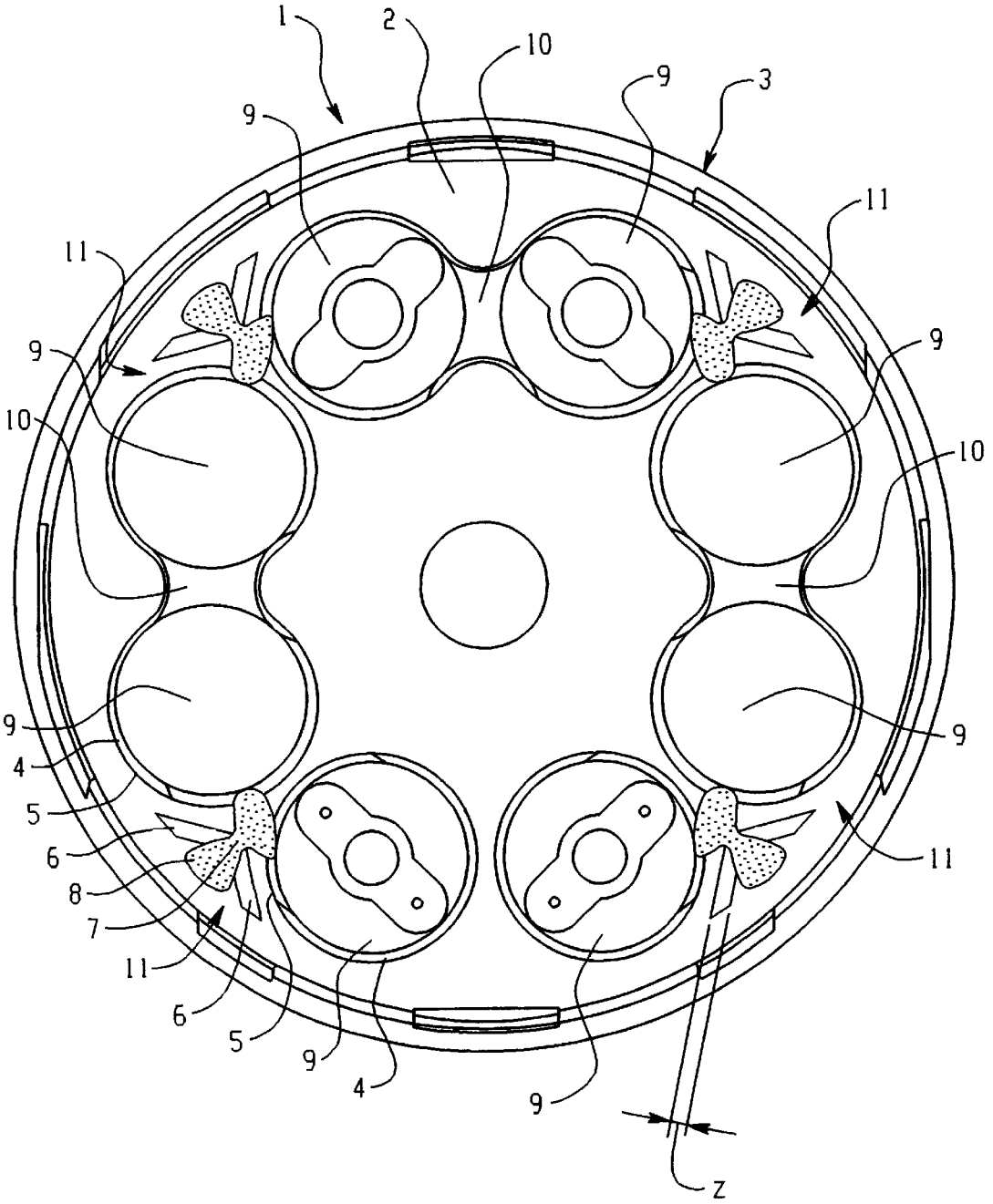

The FIGURE shows an embodiment of the discharge lamp cap according to the invention. This is a so-called OCT-type compact fluorescent lamp incorporating a discharge tube comprising four (4) U-shaped light-emitting tube sources for a total of eight tube legs. The FIGURE shows a cap 1 together with tube legs 9 placed and secured to it with an adhesive. Tube legs 9 are made from magnesia glass and are connected with each other via bridges 10. Base plate 2 of cap 1 is surrounded by a rim 3 protruding from the base plate 2 in a direction outward from the page. Ribs 6 are arranged in pairs projecting from the plane of the base plate 2 and formed in space portions 11 bordered by the rim 3 and arcs 5 of two neighboring openings 4. The pairs of ribs 6 converge towards the tube legs 9 to be fixed, i.e. towards the arcs 5. A slot 7 is formed between the ribs 6 for an adhesive 8. In the embodiment shown, the height of the ribs 6 (i.e. their protrusion from the base plate 2) is at least 0.5 mm, preferably 3 mm, their width z is 1 mm and the smallest width of the slot 7 between the ribs 6 is 1 to 2 mm.

The ribs 6 may be formed during injection molding of the cap 1. The tube legs 9 of the discharge tube are inserted into the openings 4 of the cap 1 and a thixotropic adhesive 8 is pressed between the ribs 6 in the arrangement shown in the FIGURE so that the adhesive 8, having flowed out between the ribs 6, reaches the tube legs 9 placed in two closest neighboring openings. The adhesive 8 is generally used in a quantity that permits the adhesive to exceed the height of the ribs 6.

In the FIGURE, each tube leg 9 and space portion 11 are indicated in which the rib construction for the adhesive sticking is provided. However, the openings 4, the arcs 5, the ribs 6, the slots 7, the adhesive 8 and the width z are indicated only at one space portion since they are repeated at the other three places. Correspondingly, all the tube legs 9 are secured to cap 1.

The embodiment according to the invention may be implemented in several ways in accordance with the scope of protection according to the claims. Therefore, the protection is not intended to be limited to the embodiment described above.

What is claimed is:

1. A discharge lamp cap for securing one or more discharge tubes to a housing, the cap comprising:

a base plate having at least one pair of openings therein, each opening for receiving a corresponding leg of the discharge tubes;

the at least one pair of openings defining a space portion therebetween, the space portion extending outward to the perimeter of the base plate;

a rib pair on the at least one space portion for guiding adhesive from an outer edge of the base plate towards one or more of the openings.

2. The discharge lamp cap according to claim 1, wherein each rib pair comprises ribs that converge in a direction opposite the perimeter of the base plate.

3. The discharge lamp cap according to claim 1, wherein each rib pair comprises ribs that converge in a direction towards the perimeter of the base plate.

4. The discharge lamp cap according to claim 1, further comprising a rim extending around the perimeter of the base plate, each rib pair being disposed at a sufficient distance from the perimeter of the base plate that the adhesive is prevented from migrating to the perimeter of the base plate.

5. The discharge lamp cap according to claim 1, wherein each rib pair forms a slot therebetween, the slot broadening in a direction away from the perimeter of the base plate.

6. The discharge lamp cap according to claim 5, wherein the width of the slot is at least 1 millimeter.

7. The discharge lamp cap according to claim 1, wherein each rib pair is positioned to guide adhesive towards two adjacent openings.

8. The discharge lamp cap according to claim 1, wherein the ribs extend at least 3 millimeters from the base plate.

9. The discharge lamp cap according to claim wherein the width of the ribs is about 1 millimeter.

10. The discharge lamp cap according to claim 1, wherein the openings are arcuate.

11. A method for assembling a discharge lamp comprising the steps of:

a) providing at least one discharge tube having one or more legs;

b) forming a cap for securing the discharge tube legs, the cap including a base plate having a perimeter, an arcuate opening for receiving each of the legs, and at least one pair of ribs for guiding adhesive towards one or more of the openings;

c) securing one or more of the legs to the base plate by providing adhesive in the vicinity of the at least one rib such that the adhesive is guided by the rib towards one or more of the openings.

12. The method according to claim 11, wherein the step of forming a cap comprises the step of injection molding.

13. The method according to claim 11, wherein the step of securing comprises the step of using a thixotropic adhesive.

14. The method according to claim 11, wherein the step of securing further comprises the steps of heating a thermoplastic adhesive and then pressing the heated thermoplastic between one or more of the pairs of ribs.

15. A discharge lamp cap for securing one or more discharge tubes to a housing, the cap comprising:

a base plate having at least one pair of openings therein, each opening for receiving a corresponding leg of the discharge tubes;

a rim on the periphery of the base plate;

a space portion being defined between each adjacent pair of openings, each space portion extending outward to the periphery of the base plate;

a rib pair on the at least one space portion for guiding adhesive from the periphery of the base plate towards one or more of the openings.

* * * * *